United States Patent [19]

James

[11] 3,993,003

[45] Nov. 23, 1976

[54] COLLAPSIBLE STOOL

[76] Inventor: Joseph W. James, 501 W. Whiting, Fullerton, Calif. 92632

[22] Filed: Aug. 11, 1975

[21] Appl. No.: 603,545

[52] U.S. Cl. ..... 108/112

[51] Int. Cl.[2] ..... A47B 3/00

[58] Field of Search ..... 108/129, 112, 114, 113, 108/115, 125; 248/188.6, 156; 297/135

[56] References Cited

UNITED STATES PATENTS

| | | | |
|---|---|---|---|
| 609,669 | 8/1898 | Greenleaf et al. | 108/112 |
| 983,674 | 2/1911 | Brown | 160/230 X |
| 1,044,879 | 11/1912 | Fye | 248/188.6 |
| 1,201,185 | 10/1916 | Holter | 108/114 |
| 1,553,036 | 9/1925 | Foss | 108/112 |
| 1,573,691 | 2/1926 | Eichberg | 108/129 |
| 2,829,081 | 4/1958 | Sweem | 160/230 X |
| 3,610,224 | 10/1971 | Marshall | 248/188.6 |
| 3,884,159 | 5/1975 | Faria | 108/112 |

*Primary Examiner*—James T. McCall
*Attorney, Agent, or Firm*—Philip M. Hinderstein

[57] ABSTRACT

A collapsible stool including a plurality of slats which are connected in side-by-side relationship by a plurality of flexible material hinges which permit the slats to be positioned in a folded-up configuration for transportation and storage. A pair of arms are pivotably connected to the bottom surfaces of the outer slats, at the opposite corners of the stool, so that the arms may be positioned parallel to the slats or perpendicular thereto. Each arm supports a pair of legs at the opposite ends thereof which are collapsible with the arms or extendable outwardly to support the stool above a surface. A locking mechanism made integral with two of the legs locks the free ends of the arms to the slats when the legs are extended outwardly.

3 Claims, 6 Drawing Figures

COLLAPSIBLE STOOL

BACKGROUND OF THE INVENTION

1. Field of the Invention.

The present invention relates to a collapsible stool and, more particularly, to a highly simplified, unitary chair structure which may be collapsed for transportation and storage and which may be assembled to provide a rigid seating surface.

2. Description of the Prior Art.

There are a variety of circumstances where it is desirable to provide a seating surface which is collapsible. For example, it is desirable that a seating surface be collapsible so that it may be stored in as small a space as possible when not in use. In addition, where the seating surface is to be portable, being collapsible will normally facilitate transportation to the site of use.

With the above and other advantages of a collapsible seating surface in mind, numerous attempts have been made to provide such a structure for a wide variety of purposes. Examples of collapsible stools, chairs, tables, and the like, are disclosed in U.S. Pat. NOs. 2,257,103; 2,681,841; 2,740,681 3,249,383, and 3,884,159.

As can be seen from an inspection of such patents, it is common to provide a work or seating surface by securing a plurality of elongate, rigid slats in side-by-side relationship to one or more flexible sheets so that the slats and the sheet may be rolled or folded up for transportation and storage. An additional mechanism is then required to maintain the slats in a coplanar array with the side edges of each slat contacting the respective side edges of adjacent slats so that the slats and the flexible sheet provide a rigid work or seating surface. In the case of a seating surface, it is also required to provide a plurality of legs to support the seating surface at a spaced distance from a support surface.

Heretofore, such additional mechanisms for maintaining the slats in a coplanar array and for providing a plurality of legs have been relatively complex, requiring multiple parts which must be separated from the slats and which can be lost or misplaced. Other disadvantages of prior collapsible structures will be evident from an inspection of the above patents.

SUMMARY OF THE INVENTION

According to the present invention, there is provided a collapsible stool which solves these problems in a manner unknown heretofore. The present stool is a unitary structure which, in one configuration thereof, may be folded up into a small space for transportation and storage. On the other hand, when unfolded, the present stool may be locked into a position providing a rigid seating surface which may be used by artists, architects, builders, geologists, surveyors, and the like, when sketching or working in the field. In addition, the present collapsible stool may be used in the home to provide a handy seating surface which may be disassembled for storage when not in use.

Briefly, the present collapsible stool comprises a plurality of elongate, rigid slats positioned in side-by-side, parallel relationship; a plurality of sheets of flexible material for interconnecting adjacent slats, the sheets permitting the slats to be positioned in a coplanar array with the side edges of each slat contacting the respective side edges of adjacent slats and to be positioned in a collapsed position with the top and bottom surfaces of each slat contacting the respective top or bottom surfaces of adjacent slats; a pair of elongate arms; pins for pivotably connecting first ends of the arms to the bottom surfaces of the outer slats of the array of slats, at opposite corners thereof, the arms being positionable in first positions, parallel to the slats, so as to be positionable in the collapsed position with the slats, the arms being positionable in second positions, perpendicular to the slats, adjacent the opposite ends of each of the slats; four elongate legs; and pins for pivotably connecting first ends of the legs to the first and second ends of each of the arms, the legs being positionable in first positions, parallel to the arms, so as to be positionable in the collapsed position with the slats and the arms, the legs being positionable in second positions, generally perpendicular to the arms, for supporting the slats above a support surface. According to a preferred embodiment of the invention, the outer slats have grooves in the bottom surfaces thereof which are aligned with the legs connected to the second ends of the arms when the arms are in the second positions and the stool further comprises pins extending across the grooves in the outer slats; and a hook connected to the first ends of the legs connected to the second ends of the arms, the hooks engaging the pins when the arms and legs are in their respective second positions so as to lock the second ends of the arms to the outer slats of the array when the stool is in its open position.

OBJECTS

It is therefore an object of the present invention to provide a collapsible stool.

It is a further object of the present invention to provide a highly simplified, unitary chair structure which may be collapsed for transportation and storage and which may be assembled to provide a rigid seating surface.

It is a still further object of the present invention to provide a collapsible stool for use by artists, architects, builders, geologists, surveyors, and the like.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
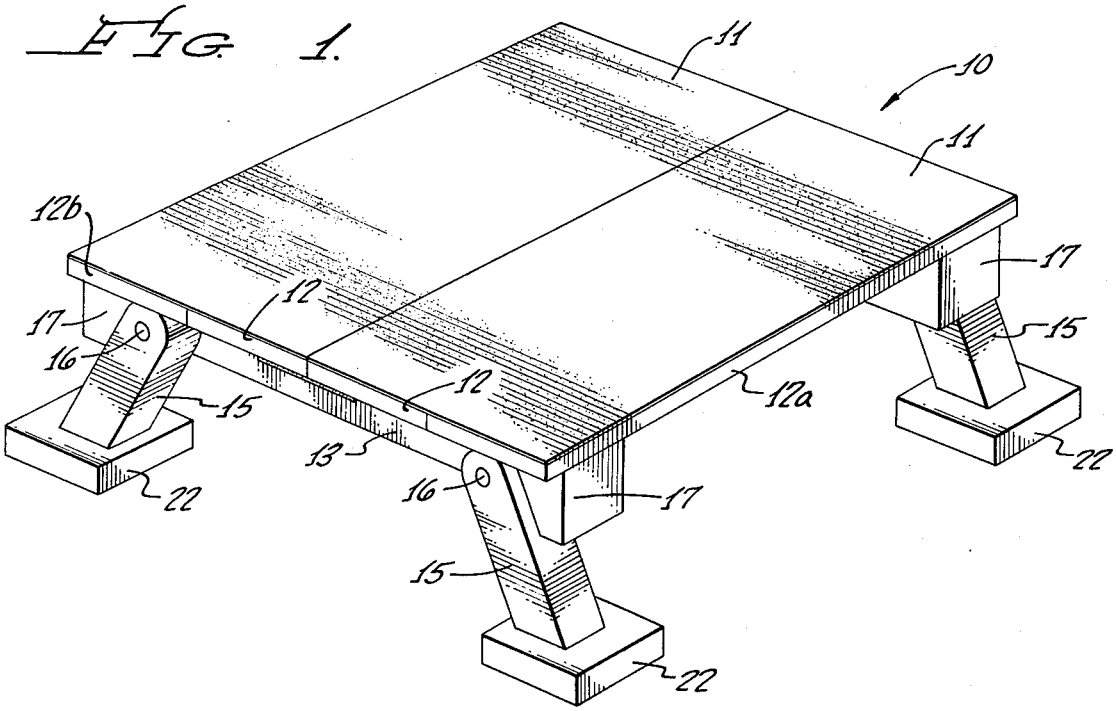
FIG. 1 is a perspective view of a collapsible stool constructed in accordance with the teachings of the present invention, shown in the open position.

Referring now to the drawings, there is shown a collapsible stool, generally designated 10, comprising a plurality of elongate, rigid slats 12 which are positioned in side-by-side, parallel relationship. Stool 10 preferably includes four slats which are made from wood or any other suitable material. Adjacent slats 12 are interconnected by means of a plurality of sheets 11 of flexible material which are connected between the top and bottom surfaces of adjacent slats 12 to permit a hinging action therebetween. More specifically, one sheet 11 extends across the top surfaces of the first two slats, the next sheet 11 extends across the bottom surfaces of the second and third slats, the third sheet 11 extends across the top surfaces of the third and fourth slats, etc. Sheets 11 may be made from any suitable heavy-duty duty, flexible material, such as vinyl or the like, and are connected to slats 12 in any convenient manner, such as by use of a suitable adhesive material.

As shown in FIGS. 1–4, slats 12 are positionable in a coplanar array with the side edges of each slat 12 contacting the respective side edges of adjacent slats 12. As shown in FIG. 5, slats 11 are also positionable in a collapsed position with the top surfaces of the first and second slats and the top surfaces of the third and fourth slats in contact and with the bottom surfaces of the second and third slats in contact.

Figure 2:
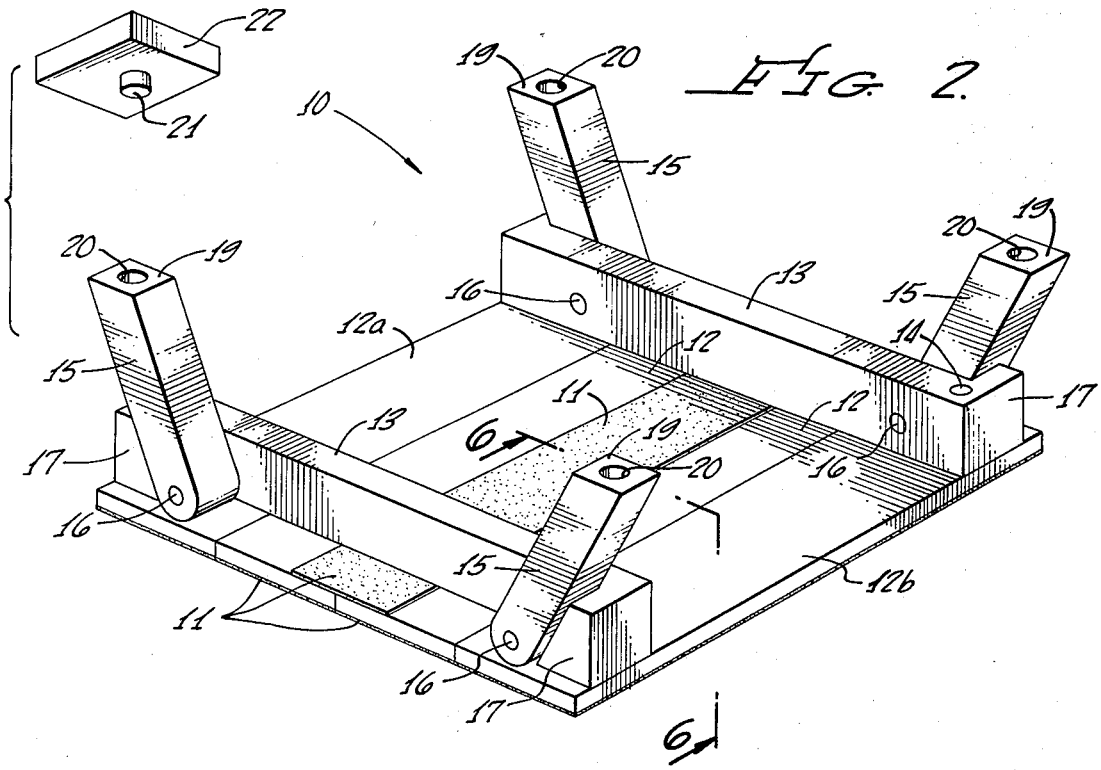
FIG. 2 is a bottom perspective view of the collapsible stool of FIG. 1.
Figure 3:
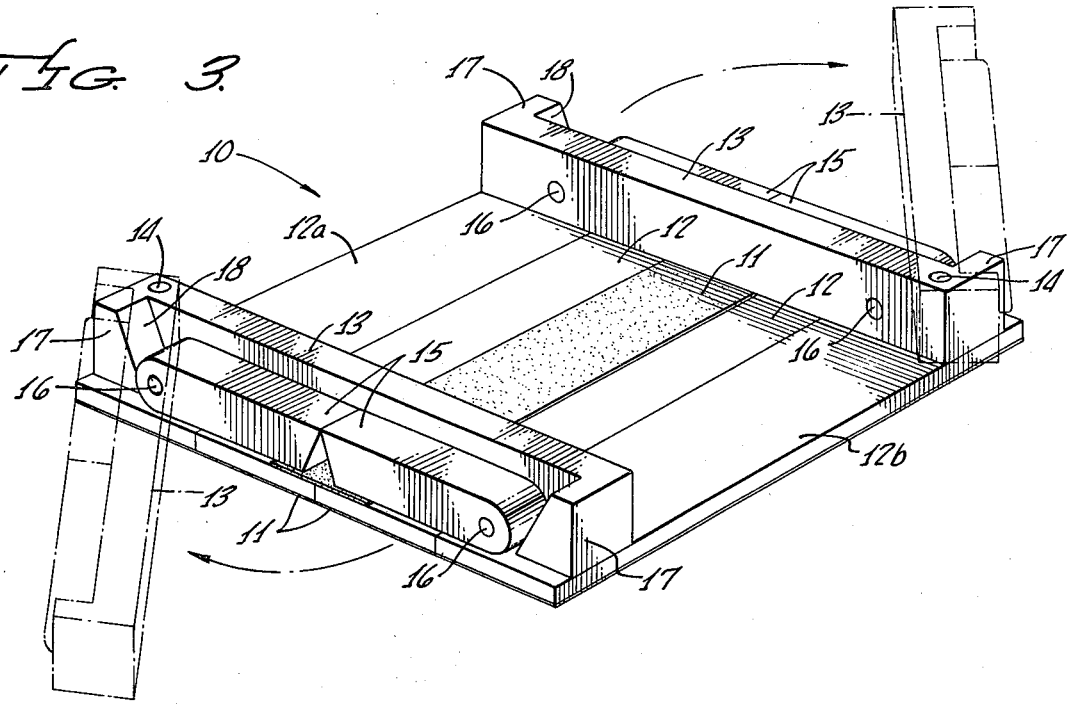
FIGS. 3 and 4 are bottom perspective views of the collapsible stool of FIG. 1, shown in partially collapsed positions.

Stool 10 further comprises a pair of elongate, generally rectangular arms 13, each having a length approximately equal to the total width of slats 12. First ends of arms 13 are pivotably connected to the bottom surfaces of the outer slats 12a and 12b, at opposite corners thereof, such as by means of nuts and bolts, pins, or the like, designated 14. As shown most clearly in FIGS. 3 and 4, pins 14 permit arms 13 to be positionable in first positions, shown in FIGS. 4 and 5, parallel to slats 12, so as to be positionable in the collapsed position with slats 12. Pins 14 also permit arms 13 to be positionable in second positions, perpendicular to slats 12, as shown in FIGS. 1, 2 and 3, adjacent the opposite ends of each of slats 12. In these second positions, arms 13 support the opposite ends of slats 12 so that slats 12 provide a planar surface, as shown in FIG. 1.

Figure 5:
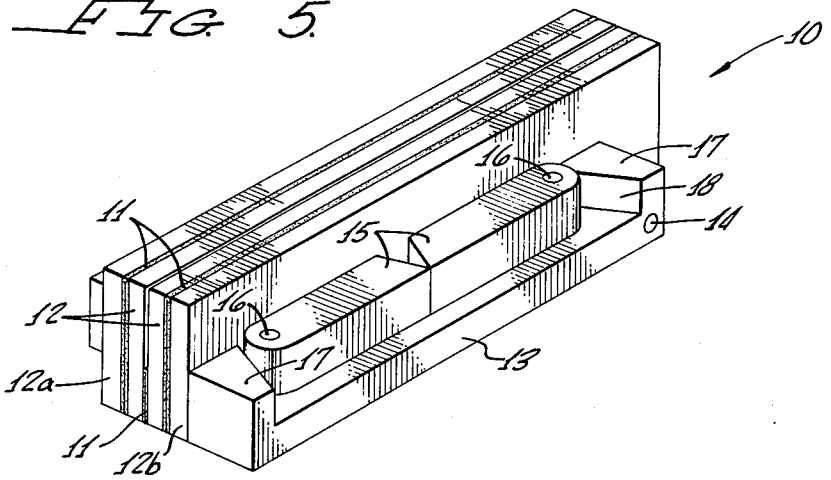
FIG. 5 is a bottom perspective view of the collapsible stool of FIG. 1, shown in the collapsed position.
Figure 6:
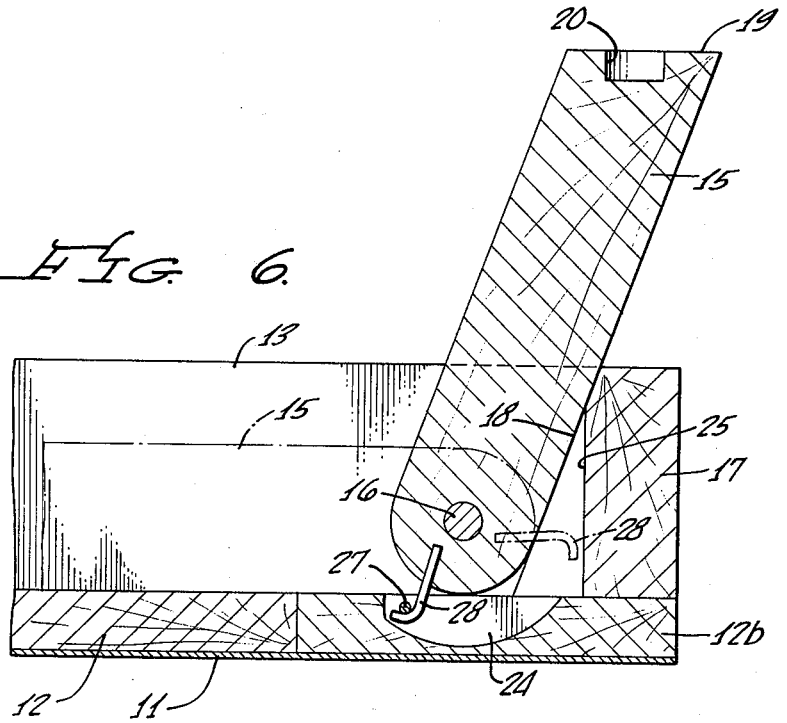
FIG. 6 is an enlarged sectional view taken along the line 6—6 in FIG. 2.

Stool 10 further comprises four, identical, elongate legs 15, first ends of which are pivotably connected by means of nuts and bolts, pins, or the like, designated 16, to the opposite first and second ends of each of arms 13. Pins 16 permit legs 15 to be positionable in first positions, shown in FIGS. 3, 4 and 5, parallel to arms 13, so as to be positionable in the collapsed position with slats 12 and arms 13. Pins 16 further permit legs 15 to be positionable in second positions, generally perpendicular to arms 13, actually at an acute angle relative thereto, as shown in FIGS. 1, 2 and 6, for supporting slats 12 above a support surface and for providing a seating surface.

Pins 16 extend laterally through the first ends of legs 15 and through the sides of arms 13. In order to maintain legs 15 in the second positions thereof, each end of arm 13 may be provided with a stop 17 having a suitably angled surface 18 which is contacted by legs 15 when in the second positions. By positioning surface 18 at an angle, legs 15 rest firmly against surfaces 18 when pressure is applied to slats 12 when used as a seating surface. The second ends of legs 15 are positioned at an angle relative to the longitudinal axes thereof so that surfaces 19 are parallel to slats 12 when stool 10 is in the open position. Surfaces 19 may be provided with holes 20 therein for receipt of pins 21 connected to footpads 22 to permit connection of footpads 22 to legs 15, if desired.

While the above described structure supports slats 12 in the position shown in FIG. 1 when assembled, it is possible for the middle slats 12 to move upwardly, causing partial collapsing of stool 10. To prevent this from occurring, stool 10 further includes means for locking the free ends of arms 13 to outer slats **12*a* and 12*b* when arms 13 are in the open positions shown in FIGS. 1–3. More specifically, and as shown most clearly in FIG. 6, outer slats 12a and 12b have grooves 24 in the bottom surfaces thereof, perpendicular to the longitudinal axes of slats 12*a* and 12*b*, grooves 24 being aligned with the first ends of legs 15 when arms 13 are in the positions shown in FIGS. 1–3 and 6. Furthermore, the stops 17 at the free ends of arms 13 have grooves 25 in the surfaces 18 thereof, grooves 25 being aligned with grooves 24 when arms 13 are in the positions shown in FIGS. 1, 2 and 6. A pin 27 extends across each of grooves 24 in slats 12*a* and 12*b*, pins 27 being extended through the end edges of slats 12*a* and 12*b*. A hook 28 is connected to the first ends of each of the legs 15 connected to the free ends of arms 13, hooks 28 extending perpendicular to pins 16. As shown in FIG. 6, hooks 28 are positioned so that they extend into grooves 25 in stops 17 when legs 15 are positioned parallel to arms 13, hooks 28 being hidden within grooves 25 under these circumstances. However, when legs 15 are rotated about pins 16 to the open positions shown in FIGS. 1 and 2, hooks 28 enter into grooves 24 in slats 12*a* and 12*b* so that when legs 15 reach the fully open positions, in contact with surfaces 18 of stops 17, hooks 28 engage pins 27, thereby locking the free ends of arms 13 to outer slats 12*a* and 12*b*** and locking the assembly to prevent collapsing thereof.

In operation, and as shown in FIGS. 1 and 2, with slats 12 positioned in the coplanar array, arms 13 are pivotable relative to pins 14 to positions perpendicular to slats 12, extending along the end edges of slats 12. In this position, legs 15 are pivotable about pins 16, relative to arms 13, with hooks 28 engaging pins 27 as explained previously. Pins 21 of footpads 22 are insertable into holes 20 in the end surfaces 19 of legs 15 and stool 10 may be inverted to provide a seating surface, as shown in FIG. 1.

When it is desired to collapse stool 10, it is first inverted, to the position shown in FIG. 2, permitting removal of footpads 22. Legs 15 are then pivotable around pins 16 until they are parallel to arms 13, as shown in FIG. 3. When this occurs, hooks 28 simultaneously release pins 27 and resume their positions in grooves 25 in stops 17.

Figure 4:
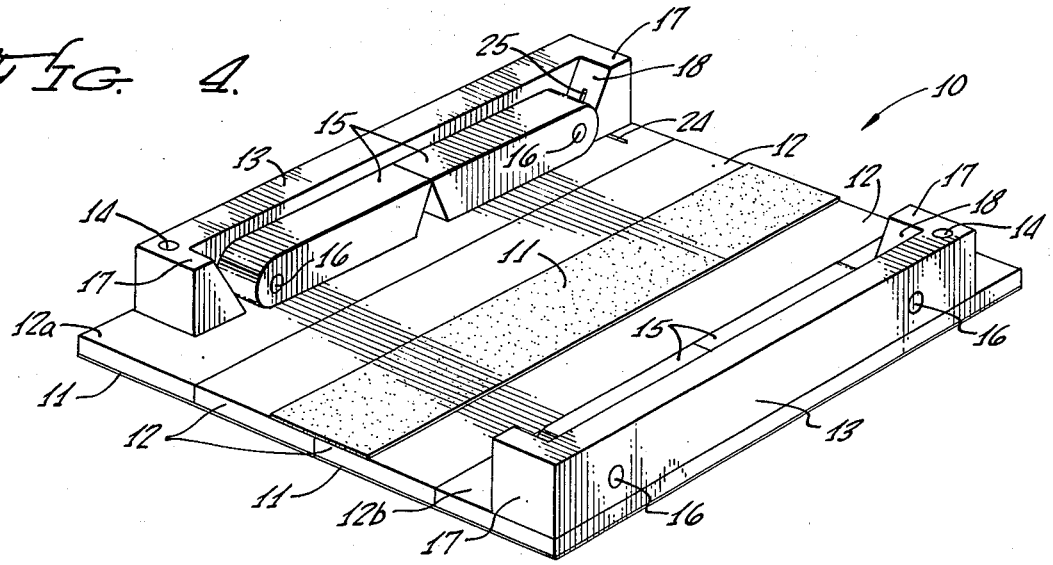

Arms 13 are now pivotable around pins 14 to the positions shown in FIG. 4, parallel to and in contact with outer slats **12*a* and 12*b*. At this time, sheets 11 permit folding of slats 12 to the position shown in FIG. 5. In this folded-up configuration, stool 10** may be readily stored until needed or transported for use in another location.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A collapsible stool comprising:

a plurality of elongate, rigid slats positioned in side-by-side, parallel relationship;

means for interconnecting adjacent slats, said means permitting said slats to be positioned in a coplanar array with the side edges of each slat contacting the respective side edges of adjacent slats and to be positioned in a collapsed position a pair of elongate arms;

means for pivotably connecting first ends of said arms to the bottom surfaces of the outer slats of said array of slats, at opposite corners thereof, said arms being positionable in first positions, parallel to said slats, so as to be positionable in said collapsed position with said slats, said arms being positionable in second positions, perpendicular to said slats, adjacent the opposite ends of each of said slats;

four elongate legs;

means for pivotably connecting first ends of said legs to the first and second ends of each of said arms, said legs being positionable in first positions, parallel to said arms, so as to be positionable in said collapsed position with said slats and said arms, said legs being positionable in second positions, generally perpendicular to said arms, for supporting said slats above a support surface; and means for automatically locking said second ends of said arms to said outer slats of said array when said arms are in said second positions and said legs connected to said second ends of said arms are pivoted to said second positions.

2. A collapsible stool according to claim 1 wherein said outer slats have grooves in the bottom surfaces thereof which are aligned with said legs connected to said second ends of said arms when said arms are in said second positions, and wherein said locking means comprises:

pins extending across said grooves in said outer slats; and a hook connected to said first ends of said legs connected to said second ends of said arms, said hooks engaging said pins when said arms and said legs are in said second positions.

3. A collapsible stool according to claim 2 wherein each of said arms has a pair of stops made integral with the opposite ends thereof, said legs resting against said stops, at acute angles relative to said slats, when in said second positions, with said hooks engaging said pins.

* * * * *